United States Patent [19]

Larsen

[11] 4,118,188

[45] Oct. 3, 1978

[54] PROCESS FOR IMPROVING THE BULKINESS OR TEXTURATION OF SYNTHETIC MULTIFILAMENT TEXTILE MATERIALS

[75] Inventor: Hans-Ole Larsen, Hvidovre, Denmark

[73] Assignee: Ultrasona AG, Zurich, Switzerland

[21] Appl. No.: 671,108

[22] Filed: Mar. 29, 1976

Related U.S. Application Data

[63] Continuation of Ser. No. 488,227, Jul. 12, 1974, abandoned, which is a continuation of Ser. No. 134,072, Apr. 14, 1971, abandoned.

[30] Foreign Application Priority Data

Apr. 14, 1970 [GB] United Kingdom ..... 17786/70

[51] Int. Cl.[2] ..... D06M 1/14; D06M 5/18

[52] U.S. Cl. ..... 8/130.1; 8/178 E; 264/342 R

[58] Field of Search ..... 8/130.1, 117, 178 E; 264/342 R

[56] References Cited

U.S. PATENT DOCUMENTS 3,630,662 12/1971 Brody ..... 8/178 E

*Primary Examiner*—Theodore Morris

*Attorney, Agent, or Firm*—Watson, Cole, Grindle & Watson

[57] ABSTRACT

In a method of treating a textile material in a shrinking bath containing a swelling agent comprising the step of introducing into said bath a driving-off agent which substantially reduces the solubility of the swelling agent in the shrinking bath.

6 Claims, No Drawings

PROCESS FOR IMPROVING THE BULKINESS OR TEXTURATION OF SYNTHETIC MULTIFILAMENT TEXTILE MATERIALS

This is a continuation of copending application Ser. No. 488,227, filed July 12, 1974, which application in turn is a continuation of copending application Ser. No. 134,072, filed Apr. 14, 1971 both abandoned.

BACKGROUND OF THE INVENTION

As is well known, such textile materials, e.g. made from polyamides, acrylonitriles, acetates and triacetates, polyesters and polyvinyl chlorides, while having excellent properties in many respects, suffer from the drawbacks as compared with textile material of vegetable or animal origin, that they have a hard touch and a rather glossy appearance. Besides, they have poor heat insulating properties and will only absorb or adsorb very small quantities of moisture.

In order to remove these drawbacks, i.e. to improve the bulkiness and/or texturation of the textile material, a process has been proposed according to which the textile goods are first subjected to treatment in a strongly attacking shrinking bath containing as the active component a swelling agent, while at the same time being subjected to ultrasonic waves, and are immediately thereafter washed with a washing liquid that may contain a neutralizing agent for the active component of the shrinking liquid.

As the active component of the shrinking liquid phenol in a concentration of 3–8% in aqueous solution has up to now primarily been used for the treatment of polyamides, but many other compounds may come into consideration, depending on the type of synthetic textile material.

As a result of this known process, the filaments or fibres of the yarn are spread apart, whereby a great number of small cavities are formed between the individual filaments or fibres, which cavities will give the thread as a whole somewhat more fluffy contours, whereby the fabric becomes more voluminous and less glossy, and will also contribute towards increasing the heat insulating and moisture adsorbing or absorbing properties.

In order to obtain useful results, it has been found necessary to operate at very short and well-defined times of treatment, viz. only a fraction of one minute in the shrinking bath. If the time of treatment is increased and the concentration of the shrinking agent is made correspondingly lower, it is found that just a uniform shrinking, but no spreading of the filaments or fibres will take place.

It is a drawback of the known process that, in addition to the useful quantity of swelling agent migrating into the filaments of the yarn and causing their surface layers to swell, a relatively great quantity of swelling agent is removed from the shrinking bath with the water soaking the textile material. This additionally removed quantity of swelling agent does not only result in increased processing costs, but may also be difficult to dispose of. Thus, if in the case of polyamide textiles phenol is used as a swelling agent, a considerable quantity of phenol will go into the washing water and may be a source of considerable nuisance if the waste water is drained off to a sewage system, or to rivers or lakes.

SUMMARY OF THE INVENTION

According to the invention a considerable saving of swelling agent, and not least a considerable reduction of waste swelling agent may be obtained by incorporating in the bath of treatment an ingredient which substantially reduces the solubility of the swelling agent. It has been found that the effect of such an ingredient is to increase the rate of migration of the swelling agent from the bath into the synthetic material. Such an ingredient may therefore be referred to as a driving-off agent. The driving-off effect is particularly pronounced when the concentration of the swelling agent approaches saturation. It is therefore proposed to use an ingredient, which reduces the point of saturation of the swelling agent to a value lower than the concentration that would be used for the treatment if this were carried out by means of a purely aqueous solution of the same swelling agent. Thus the process of the invention comprises the steps of preparing an aqueous shrinking bath containing a swelling agent selected from the group consisting of phenol and cresols, increasing the ability of the swelling agent, at a given concentration of the latter in the bath, to migrate into the internal structure of the individual fibers of a textile material by reducing the solubility of the swelling agent in the bath by incorporating into the latter a solubility reducing quantity of a water-soluble driving-off agent selected from the group consisting of NaCl, $Na_2SO_4$, $MgSO_4$, $Al_2(SO_4)_3$, $NaH_2PO_4$, $NH_4Cl$, $(NH_4)_2CO_3$, $HCOONH_4$ and $(NH_4)_2HPO_4$, the concentration of said driving-off agent being at least 10% by weight based on the weight of said bath.

In the most important mode of carrying out the invention, where phenol is used as a swelling agent in the treatment of textile material made from polyamide yarn, it has been found that NaCl is a very suitable driving-off agent. A perceptible driving-off effect can be ascertained at a NaCl content of about 10–11% by weight. From that point the effect increases rapidly up to a NaCl content of about 20% and thereafter there is only a slow increase of the effect up to the saturation point for NaCl about 25%. A suitable NaCl content for use in the process according to the invention is therefore about 20%.

The content of swelling agent should be close to that of the saturation point. This will become lower, the higher the concentration of driving-off agent. When using NaCl in a quantity of about 20% as a driving-off agent for phenol, the content of phenol may be selected at about 1.25% which is slightly below the saturation point. To ensure complete solution of the phenol and to maintain the concentration thereof close to the saturation point, the bath should preferably contain a solubilizing agent. Suitable solubilizing agents are surface active agents. The sodium salt of paratoluene sulphonic acid, generally referred to as tosylate, has been found suitable for a salt-phenol bath of the composition described and may e.g. be present in a quantity of 0.2%.

Moreover, in order to prevent miscoloring owing to oxidation, the bath of treatment may with advantage contain an antioxidant such as ascorbic acid in a quantity of say 0.2%.

The pH-value of the treatment bath should be maintained at a value not exceeding 8 in order to avoid hydrolysis of the fibres.

When using a combination of a driving-off agent and a solubilizing agent such as tosylate the solubility of phenol is essentially independent of the temperature so that the same bath may be used within a wide range of temperatures, say from room temperature to about 60° C. By varying the temperature the effect of the bath on the textile material may be varied. Furthermore, since the fact that the solubility does not increase significantly with increasing temperatures, the phenol concentration in the waste water which is drained off to sewage systems and the like may be kept at a minimum even when relatively high temperatures are used.

Moreover, it has been found that if the salt is permitted to remain in the textile material during the subsequent heat stabilization, which is usually carried out in a tenter frame, in which the tension of the textile material should be kept as low as possible, the heat stabilization may take place without first removing the phenol present in the soaking water. This is not possible when no salt is used, because it is then inavoidable that during the simultaneous evaporation of the soaking water and the phenol contained therein, spotwise concentrations of solid phenol may be formed before all the phenol has evaporated, whereby the textile material will be destroyed. This does not happen when the salt is left in the textile material.

It actually appears that salt or the combination of salt and phenol has an advantageous effect on the heat stabilization by improving the fixation of the fibres.

The limited and well-defined phenol concentration also has the effect that the heat stabilizing conditions will be more well-determined, and that other heating means such as high frequency heating means than those used in the prior art method can be utilized in the heat stabilizing process.

The salt will of course have to be removed from the textile material by a washing operation. This operation may be combined with a subsequent treatment to which the textile material is subjected such as dyeing.

It is a further advantage of the process according to the invention that the washing step, which in the known process must necessarily be initiated as soon as the textile material leaves the bath of treatment in order to stop the attack of the swelling agent on the textile material at the time when this is already in full progress, may, if desired, be omitted. The reason for this is that the quantity of phenol present in the soaking water is so small that if this phenol continues its attack on the textile material its concentration in the soaking water will rapidly decrease substantially below the saturation point, i.e. to a concentration in which its effect on the textile material is substantially reduced or ceases altogether.

However, it may nevertheless be desirable to subject the textile material to a washing.

A further advantage obtained by the invention is that the shrinkage caused by the swelling agent can be kept lower than when using a solution of the swelling agent in pure water, or in other words in the process according to the invention the effect of the swelling agent to increase bulkiness or texturation will be more predominant in relation to the shrinking effect than is the case in the known process. In other words the weight of the textile material per area unit does not increase to the same extent as in the prior art methods when a predetermined bulkiness is obtained.

In the bath of treatment, ultrasonic waves may be used in well known manner to promote the spreading of the filaments of the textile yarn caused by the chemical influence of the swelling agent.

DESCRIPTION OF THE PREFERRED EMBODIMENTS.

The following examples set forth compositions of shrinking baths for use in the treatment of various synthetic textile materials.

EXAMPLE I

Baths for the treatment of textile materials made from polyamides:

| | | | | |
|---|---|---|---|---|
| a) | Salt, NaCl | 500 kg | = | 20% |
| | Phenol | 42 kg | = | 1.25% |
| | Tosylate | 5.5 kg | = | 0.2% |
| | Ascorbic acid | 6 kg | = | 0.21% |
| | Water | diluted up to | | 2600 liters. |

Such a bath may also contain an anti-corrosion agent such as polyphosphates.

| | | |
|---|---|---|
| | Treatment: 10 sec. at 55° C | |
| S | (corresponding to speed of 10 m/min.). | |
| b) | Salt, NaCl | 21 |
| | Phenol | 1,28 |
| | Na-Tosylate | 0,16 |
| | $H_3PO_4$ | 1,22 |
| | NaOH | 0,56 |
| | Water | rest |
| | Treatment: 10 sec. at 55° C. | |
| c) | Salt, $Na_2SO_4$ | 19,76 |
| | Phenol | 1,19 |
| | (Na-Tosylate | 0,2) |
| | Water | rest |
| | Treatment: 10 sec. at 50° C. | |
| d) | Salt, NaCl | 15,93 |
| | m-Cresol | 0,41 |
| | (Na-Tosylate | 0,2) |
| | Water | rest |
| | Treatment: 20 sec. at 50° C. | |
| e) | Salt, NaCl | 19,72 |
| | m-Cresol | 0,61 |
| | Na-Tosylate | 0,79 |
| | Water | rest |
| | Treatment: 10 sec. at 50° C. | |
| f) | Salt, $NaH_2PO_4$ | 19,83 |
| | m-Cresol | 0,84 |
| | (Na-Tosylate | 0,2) |
| | Water | rest |
| | Treatment: 10 sec. at 50° C. | |

EXAMPLE II

Bath for the treatment of triacetate materials.

| | |
|---|---|
| Salt, $Na_2SO_4$ | 16,08 |
| Phenol | 1,88 |
| Na-Tosylate | 0,31 |
| Water | rest |
| Treatment: 10 sec. at 70° C. | |

EXAMPLE III

Bath for the treatment of polyesters.

| | |
|---|---|
| Salt, NaCl | 6,06 |
| Phenol | 9,36 |
| Na-Tosylate | 0,37 |
| Water | rest |
| Treatment: 12 sec. at 85° C. | |

I claim:

1. In a process for improving the bulkiness or texturation or both of synthetic multifilament textile materials, the steps of:

preparing an aqueous shrinking bath containing a swelling agent selected from the group consisting of phenol and cresols, increasing the ability of the swelling agent, at a given concentration of the latter in the bath, to migrate into the internal structure of the individual fibers of a textile material by reducing the solubility of the swelling agent in the bath by incorporating into the latter a solubility reducing quantity of a water-soluble driving-off agent selected from the group consisting of NaCl, $Na_2SO_4$, $Al_2(SO_4)_3$, $NaH_2PO_4$, $NH_4Cl$, $(NH_4)_2CO_3$, $HCOONH_4$ and $(NH_4)_2HPO_4$, the concentration of said driving-off agent being at least 10% by weight based on the weight of said bath, and introducing the synthetic multifilament textile material into the shrinking bath for a period of less than one minute.

2. A process as set forth in claim 1, wherein said swelling agent is phenol and said salt is NaCl.

3. A process as set forth in claim 1, wherein said swelling agent is cresol and said salt is NaCl.

4. A process as set forth in claim 1, wherein is included the step of incorporating into the bath a sufficient quantity of a solubilizing agent for the swelling agent to maintain the concentration of the latter in the bath substantially at its saturation point.

5. A process as set forth in claim 4, wherein said solubilizing agent is a sodium salt of paratoluene sulphonic acid.

6. A process as set forth in claim 1, wherein is included the step of maintaining the pH of the said bath at a numerical value of 8 or less.

* * * * *